United States Patent [19]

Ip et al.

[11] Patent Number: 5,059,771

[45] Date of Patent: Oct. 22, 1991

[54] METHOD AND CALCULATOR TO DETERMINE THE SPATIAL PARALLAX IN A 3-D PHOTOGRAPH

[75] Inventors: Sunny L. Ip, Atlanta; Augustine K. Wu, Norcross, both of Ga.

[73] Assignee: Image Technology, Inc., Norcross, Ga.

[21] Appl. No.: 330,768

[22] Filed: May 1, 1989

[51] Int. Cl.[5] ..... G06C 3/00

[52] U.S. Cl. ..... 235/64.7; 354/114; 235/88 R

[58] Field of Search ..... 235/64.7, 88 R–88 RC; 354/114, 115, 112

[56] References Cited

U.S. PATENT DOCUMENTS 3,908,112 9/1975 Lo et al. ..... 235/64.7 X 4,479,169 10/1984 Holmes ..... 235/64.7 X

*Primary Examiner*—L. T. Hix

*Assistant Examiner*—Eddie C. Lee

*Attorney, Agent, or Firm*—Harold L. Marquis

[57] ABSTRACT

A method for determining the spacing between adjacent vantage points for taking a 3-D photograph which involves computing the desired spatial parallax in accordance with the following formula:

$$P = \frac{2V\pi}{21600} E$$

where P is the desired spatial parallax, V is the viewing distance and E is the capability of the eyes to fuse the two images together expressed in terms of arc minutes of the scanning angle and utilizing results of this computation to compute the distance T between adjacent vantage points in accordance with the following formula:

$$T = \frac{BKP}{(B - K)u}$$

where B is the distance between the camera and the background object and K is the distance between the camera and the key subject and u is the back focal length of the camera lens. A calculator has been provided for making the necessary calculations.

12 Claims, 7 Drawing Sheets

TOP VIEW OF THE SLIDING DEVICE
MOUNTED WITH A 2D CAMERA

METHOD AND CALCULATOR TO DETERMINE THE SPATIAL PARALLAX IN A 3-D PHOTOGRAPH

BACKGROUND OF THE INVENTION

In lenticular type three-dimensional (3-D) photography, a plurality of two-dimensional (2-D) views of the same scene are taken from a number of horizontally spaced vantage points, and a series of 2-D images is then compressed and printed at the focal plane on the emulsion of each of the lenticules of the lenticular print film to form a 3-D composite image of the scene.

When a person is viewing a 3-D photograph, the right and left eyes see two image bands which form a stereo pair. The spatial parallax between the images of the stereo pair reconstructs the spatial effect and the sensation of depth to the photographed scene.

The method of taking and composing lenticular type 3-D photographs is explained in some of the following publications.

N. A. Valyus in *Stereoscopy* (The Focal Press 1962) at pages 195–205 discloses the basic method of taking and printing 3-D photographs on lenticular print material.

Rudolf Kingslake in *Applied Optics and and Optical Engineering* (Academic Press 1965) at pages 108–116 also discusses some of the basic principles involved in lenticular three-dimensional photography.

Takanori Okoshi in *Three-Dimensional Imaging Technique* (Academic Press 1972) at pages 61–95 discusses a number of techniques for taking three-dimensional photographs.

The following U.S. patents are of interest in connection with three-dimensional photographic techniques.

U.S. Pat. No. 3,895,867 (Lo etal)
U.S. Pat. No. 3,953,869 (Lo etal)
U.S. Pat. No. 3,960,563 (Lo etal)
U.S. Pat. No. 4,037,950 (Lo etal)
U.S. Pat. No. 4,063,265 (Lo etal)
U.S. Pat. No. 4,120,562 (Lo etal)
U.S. Pat. No. 3,482,913 (Glenn)
U.S. Pat. No. 3,518,920 (Glenn)

A major difficulty in lenticular type 3-D photographs is that the 3-D photograph frequently has either too little three dimensional effect or the image is out of focus because of too little or excessive spatial parallax between the stereo pairs. Parallax is the apparent shift in position of an element of an object field due to the relative change in position of the element and place from which the element is viewed. The spatial parallex on a lenticular 3-D photograph is simply the distance on the photograph between the images of the same object of a stereo pair.

U.S. Pat. No. 3,960,563 (column 12, line 47 through column 13, line 43) suggests that the maximum spatial parallax between two adjacent images should be controlled not to exceed five lenticules width if the width of the lenticule in the picture is greater than 5 mils, or not to exceed ten lenticules width if the width of the lenticule is smaller than 5 mils. U.S. Pat. No. 4,037,950—Lo etal (column 12, lines 28–61) also takes this same position as does U.S. Pat. No. 4,063,265—Lo etal (column 12, lines 31–64).

This technique of trying to control the spatial parallax between an image pair by setting the number of lenticules between an image pair of the same object is not effective under the following circumstances:

1. When using print materials of different lenticule width.

For example, when taking a 3-D photograph, if the lenticule wtdth of 1 mm is used, the resulting maximum permissible spatial parallax is 5 lenticule units in accordance with the above technique. However, if this same photograph is printed with the same degree of magnification on print material having a lenticule width of 0.125 mm, the resulting parallax will become 40 lenticule units which is four times the maximum permissible spatial parallax, and the 3-D photograph is totally out of focus.

2. Changing the magaification when printing a 3-D photograph.

For example, if the lenticule width is 0.15 mm (greater than 5 mils) and the photograph is magnified three times, the maximum permissible spatial parallax is five lenticule units. However, if this same photograph is printed with a magnification of fifteen times, then the parallax will become 25 lenticule units which is five times the maximum permissible spatial parallax with the photograph being out of focus.

3. When printing photographs of different size.

If 3-D photographs of different sizes are made on the same type of print material with the same lenticule width and having the same maximum parallax according to the above limitation, the 3-D effect on the photographs of different size will not be consistent as larger 3-D photographs must be viewed from a greater distance. The larger photographs require more spatial parallax in order to obtain the same 3-D effect. 3-D photographs of smaller size are viewed at a closer distance and require less spatial parallax in order for the eyes to fuse the two images together.

PRIOR ART

U.S. Pat. No. 3,908,112 (Lo etal) discloses a calculator for use in taking stereoscopic pictures. This calculator is designed to determine the location relative to the camera of the foreground element, the background element and the key subject matter element of the scene to be photographed in order to obtain the desired parallax value. This calculator is premised upon the parallax limitations set forth in U.S. Pat. Nos. 4,037,950; 4,063,265 and 3,960,563.

DETAILED DESCRIPTION OF THE DRAWINGS

It has been discovered that in order to produce a sharp, maximum 3-D effect in a photograph, the permissible spatial parallax between the two images of the same object of a stereo pair should be controlled according to the capability of the eyes to fuse the two images of the stereo pair together into a single 3-D image. The permissible spatial parallax is also controlled by the scanning angle of the eyes. It has been discovered that using the number of lenticule units between the image of the same object of the stereo pairs to control the permissible spatial parallax is not effective as has been suggested by the prior art. It has also been determined that the spatial parallax on a 3-D photograph should be decreased or increased based upon the viewing distance of the 3-D photograph so that the scanning angle remains constant. This means that the 3-D effect of -D photographs of different sizes when viewed at different distances will maintain the optimum 3-D effect.

It has been discovered that the permissible spatial parallax between the two images of a stereo pair ranges from two to ten arc minutes of the scanning angle of the eyes depending upon the relative position of the objects in the scene, the illuminating conditions of the scene and the contrast level of the objects being photographed.

The spatial parallax obtained in a stereo pair in a 3-D photograph is dependent upon:

(1) the distance between the camera and the object being photographed, (2) the distance between the vantage points from which the photograph is taken, (3) the back focal length of the camera lens.

It is important to be able to determine the permissible parallax for a 3-D photograph when a camera on a track is used to take a plurality of two-dimensional views of an object. This parallax will enable the photographer to determine how far the camera needs to be moved between each photograph.

Figure 1:
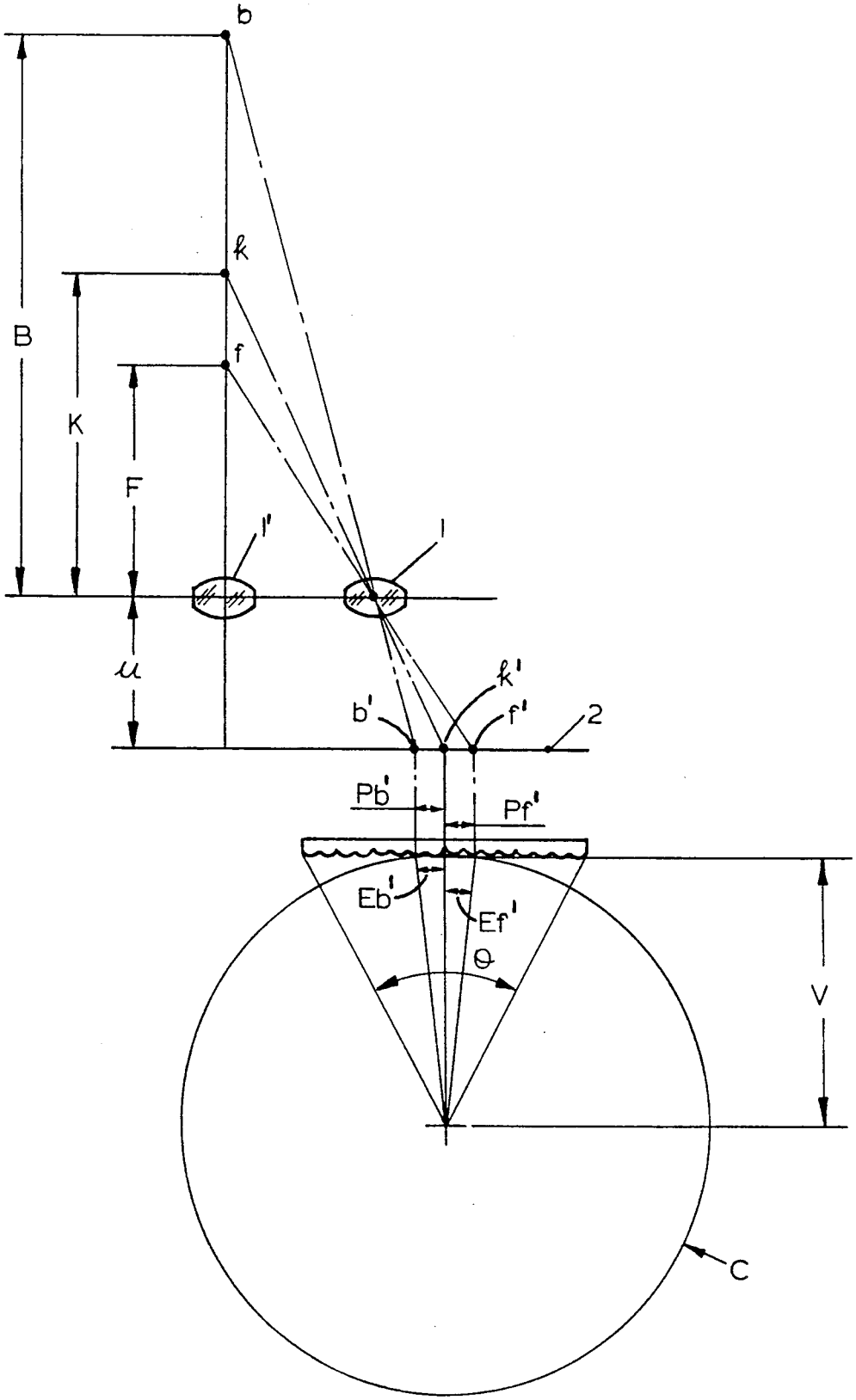
FIG. 1 is a diagrammatic view illustrating a desirable spatial parallax in a stereo pair in relation to the viewing distance of the 3-D photograph.

FIG. 1 graphically illustrates the permissible spatial parallax seen at a particular viewing distance.

It has been determined that the following equation can be used to determine the desired spatial parallax of a 3-D photograph:

$$P = \frac{2V\pi}{21600} E \tag{1}$$

where

P is the permissible spatial parallax for the 3-D photograph as illustrated in FIG. 1, V is the normal viewing distance of the 3-D photograph as illustrated in FIG. 1, $\pi$ is 3.1416, E is the capability of the eyes to fuse the two images of a stereo pair together and is expressed in terms of the arc minutes of the scanning angle of the eyes, 21,600 is the number of arc minutes in a full circle C as illustrated in FIG. 1. The viewing distance V is doubled in the above equation in order to find the diameter of the circle C.

The viewing distance V as illustrated in FIG. 1 is determined by the size of the 3-D photograph. It has been determined that a normal viewing angle of a photograph is approximately 15°. On this basis V can be determined in accordance with the following equation:

$$V = D/(2 \tan \theta/2) \tag{2}$$

where

D is the length of the 3-D photograph, $\theta$ is the viewing angle of the 3-D photograph to which a value of 15° has been given.

It has been determined from experimentation that the permissible limit of E is from 2 to 10 arc minutes depending upon the illumination and the contrast of the objects of the scene as illustrated in FIG. 1. For the purpose of the following examples, let us assume that E is equal to 3 arc minutes for the spatial parallax for the foreground image f'. Based upon experimentation, it has been determined that the maximum spatial parallax of the foreground object image f' is 50% of the spatial parallax of the background image b' because the foreground image should appear to be floating in front of the 3-D photograph. It is a virtual image and is more difficult to focus. The background image b' appears to be receding behind the 3-D photograph. Consequently, the eyes first focus on the photograph which leads to the background image b' making it easier to focus. Consequently, a greater spatial parallax can be allowed. Thus if E is equal to 3 for the foreground object image, we would expect E to equal 6 for the background object image.

FIG. 1 illustrates a background object b, a key subject object k and a foreground object f at the respective distances B, K and F from the camera lens 1 at position 1'. Camera lens 1 has the back focal length u. Objects b, k and f are focused onto the lenticular material 2 at respective positions b', k' and f'. The parallax between the background object b' and the key subject object k' on the lenticular print material 2 is Pb'. Correspondingly, Pf' is the parallax between the foreground object f' and the key subject object k' on the lenticular print material. The viewing distance V is illustrated as the radius of a circle C. The capability of the eyes to fuse the foreground object f' and the key subject object k' is illustrated as Ef'. Correspondingly, Eb' illustrates the capability of the eyes to fuse the background object b' and the key subject object k'.

According to the present invention, the spatial parallax in the 3-D picture is controlled by the permissible scanning angle of the eyes, i.e., 3-D pictures of different sizes will be viewed from different distances requiring a different degree of parallax in order to accommodate the same permissible scanning angle of the eyes (i.e., the larger size 3-D picture which is viewed at a greater distance will require a greater parallax value and a smaller 3-D picture to be viewed at a closer distance will require lesser parallax). Therefore, according to the present invention, the factors of magnification ratio of the negative 'R' and the lenticule width 'W' are not factors to consider and are not included in the equation used to calculate the desired parallax in a 3-D picture as the required parallax value in a 3-D picture will vary according to the magnification of the 3-D picture. Consequently, the size of the resulting 3-D photograph can be disregarded and the negative format of the 2-D view can be used for the computation of the spatial parallax. Once P has been determined by equation 1, the distance between adjacent vantage points can be obtained by the following equations:

$$T = \frac{BKP}{(B - K)u} \tag{3}$$

-continued or $$T = \frac{KFP}{(K - F)u} \tag{4}$$

where

T is the distance between adjacent vantage points,

B is the distance between the camera and the background object,

K is the distance between the camera and the key subject,

F is the distance between the camera and the foreground object, u is the back focal length of the camera lens, and P is the spatial parallax between adjacent stereo pairs.

Figure 2:
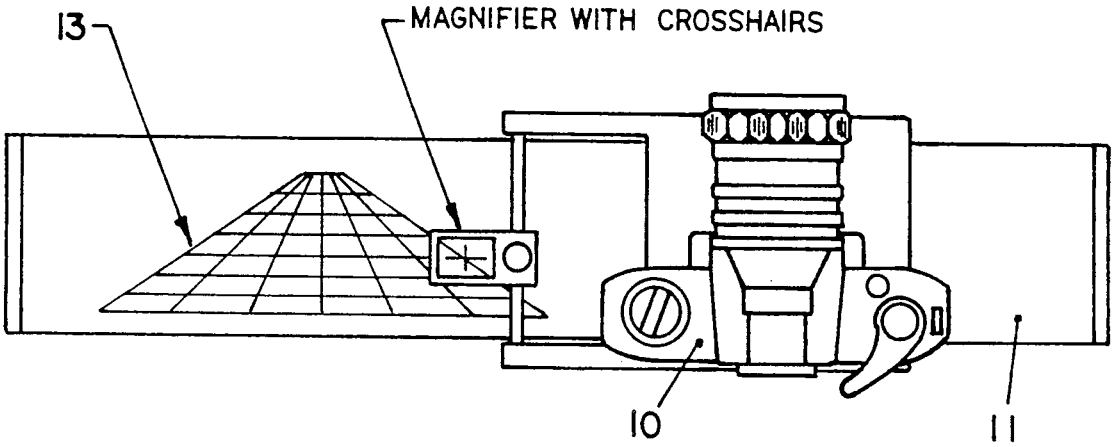
FIG. 2 is a diagrammatic view of a camera mounted on a track on which the camera can be moved horizontally to take a series of views of an object.

FIG. 2 is a diagrammatic view of a camera mounted on a track on which the camera can be moved horizontally to take a series of views of an object. The camera 10 is mounted on track 11 for horizontal movement in relation to an object (not shown). The camera may have a magnifier with crosshairs for aligning the tracking scale 13 which is utilized in the horizontal movement of the camera 10 along the track for taking a picture of an object from adjacent views. The track can be calibrated for movement in accordance with the appropriate T values determined in accordance with the method and calculator of this invention.

The distance from the camera to the foreground object F, to the key object K or the background object B in order to produce the desired parallax for a 3-D picture at a given tracking distance in millimeters between the vantage points for a given camera can be calculated in accordance with the following formulas:

$$F = \frac{uT}{\frac{uT}{K} + P} \tag{5}$$

$$K = \frac{uT}{\frac{uT}{F} - P} \tag{6}$$

$$K = \frac{uT}{\frac{uT}{B} + P} \tag{6A}$$

$$B = \frac{uT}{\frac{uT}{K} - P} \tag{7}$$

where:

B is the distance between the background and the camera;

K is the distance between the key object and the camera;

F is the distance between the foreground object and the camera;

u is the back focal length of the camera lens;

T is the distance between each vantage point;

P is the permissible spatial parallax.

Once this required distance, F, K or B has been determined, the distance between the objects and the camera can be adjusted before the picture is taken in order to achieve the desired parallax.

CONSTRUCTION AND USE OF THE CALCULATOR

Figure 3:
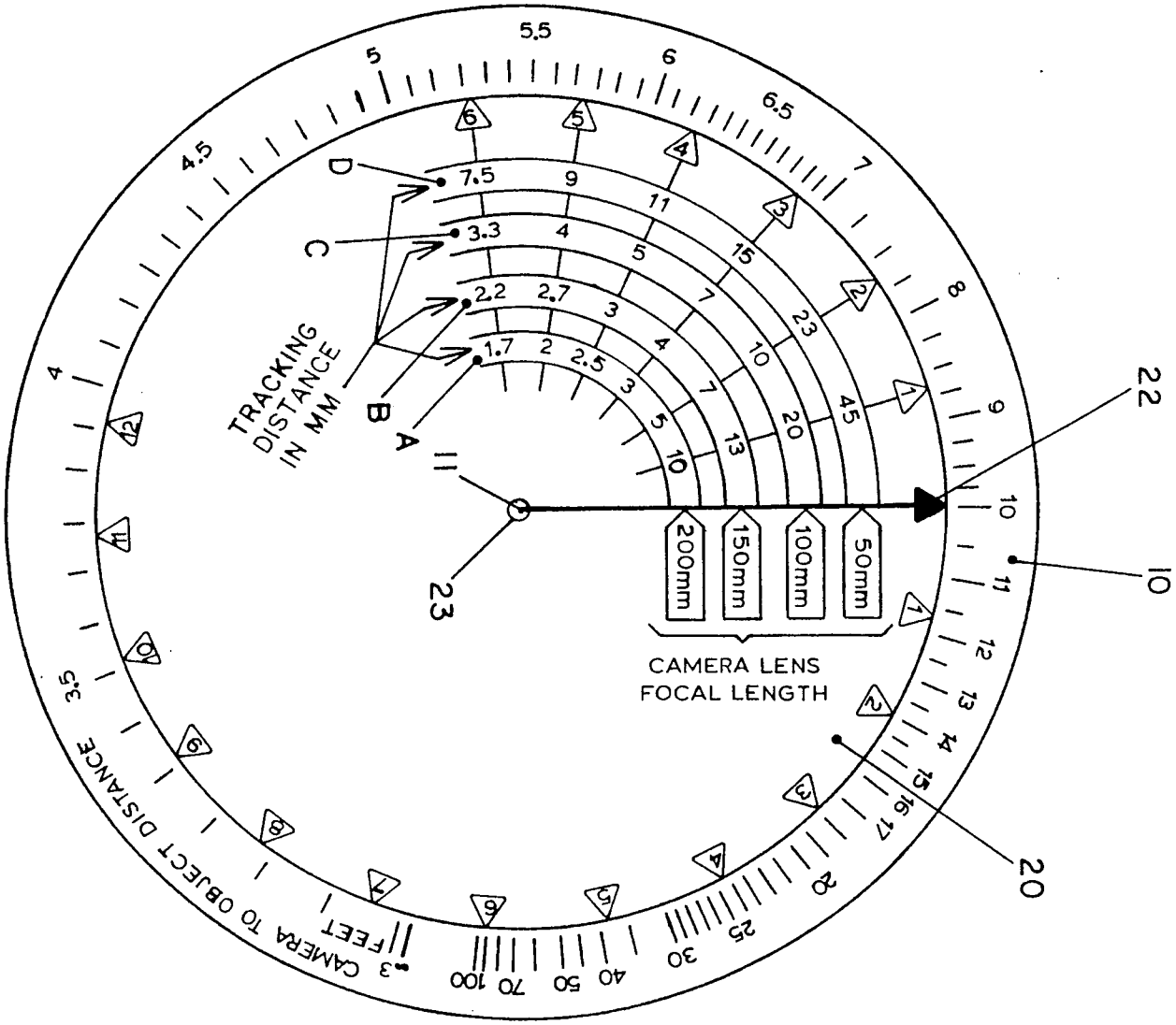
FIG. 3 portrays an illustrative embodiment of a calculator constructed in accordance with the invention.
Figure 4:
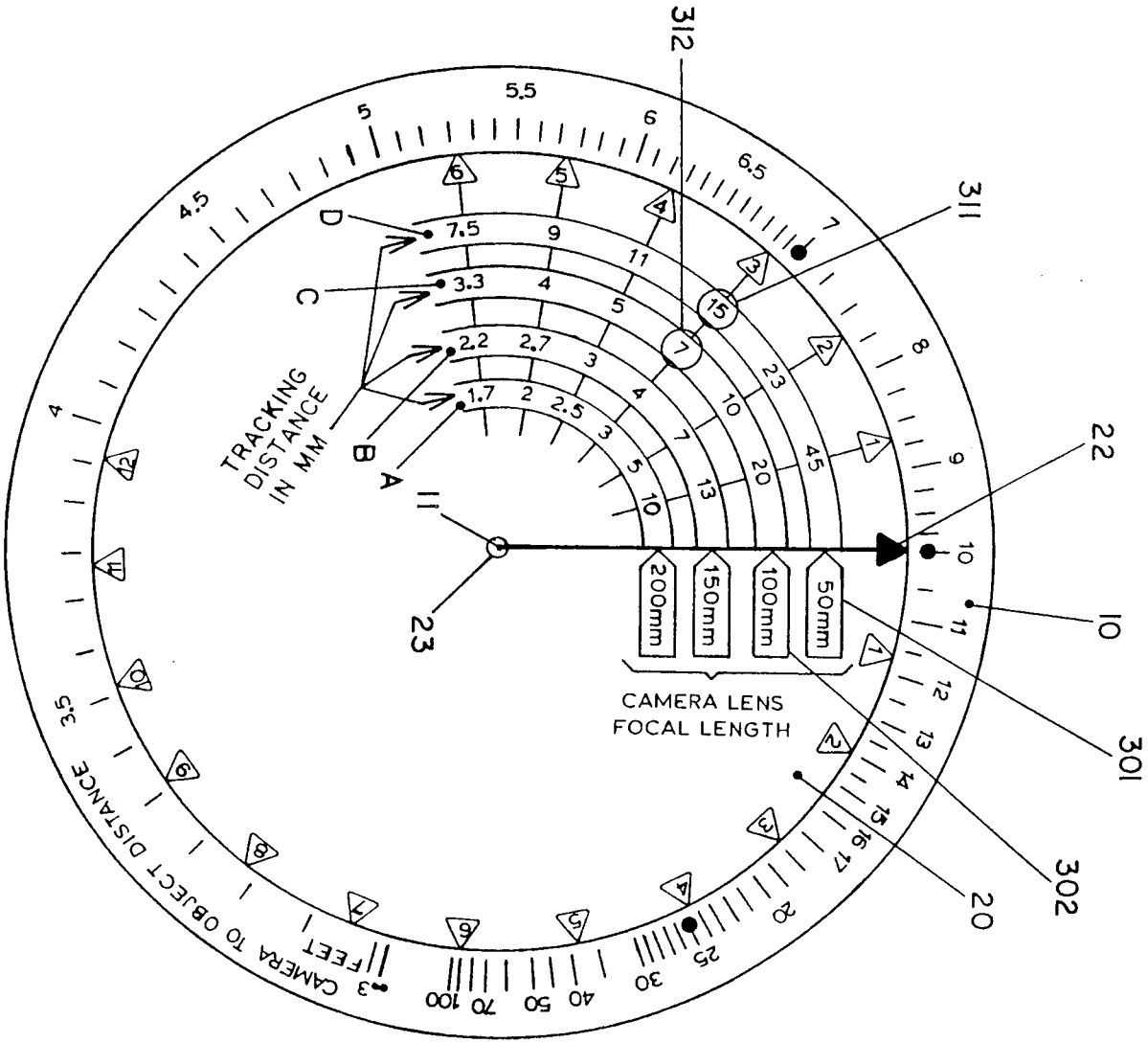
FIG. 4 the calculator at a particular setting so that the tracking distance of the camera can be determined.
Figure 5:
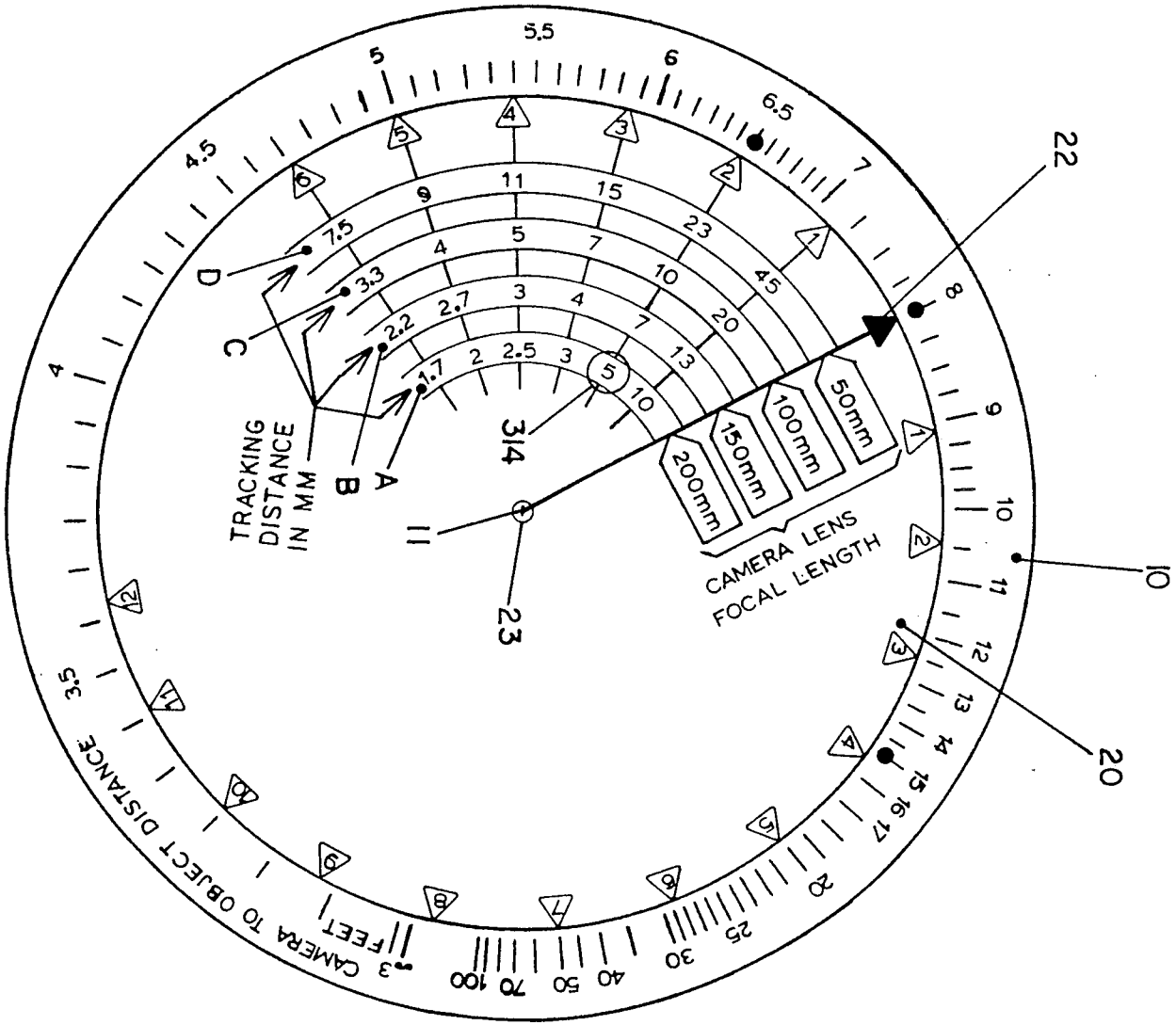
FIG. 5 portrays the calculator at a particular setting so that the tracking distance of the camera can be determined.

A circular calculator which is useful in the computation of the equations set forth above is illustrated in FIGS. 3, 4 and 5. The calculator includes the base member 10 which is circular in shape and a central reference point 11. A scale is scribed along the outside of the base member 10. This scale represents the number of feet between the camera and the object to be photographed. This scale is calibrated in feet for the convenience of the photographer. It should be noticed that the distance between the feet on this scale is much greater at closer distances than at farther distances. This is the necessary graduation in the application of the above equations to determine the tracking distance. The calculator illustrated was based upon a viewing angle of 15° and the value of E being 2. The same principle could be applied in constructing a calculator with a different viewing angle and a different E value. When the viewing angle is 15° the negative length is 60 mm and the value of E is 2, then the parallax is equal to 0.1326 which was the number used in constructing this calculator. A circular inner member 20 is attached to the base member at the circular center point 11 by a grommet 23. This inner member has four tracking distance scales A, B, C, D which are used to determine the distance the camera needs to be moved horizontally between adjacent photographs of the same scene. Scale A is for a camera lens with a back focal length of 200 millimeters. Scales are also provided for focal lengths of 50, 100 and 150 millimeters. Additional scales for other focal lengths can also be provided. A single scale can be used if only a single focal length is used.

In operation the inner member 20 is moved so that the key arrow 22 is pointed at the distance from the camera to the key subject K to be photographed. One then locates the distance from the camera to the foreground object F on the scale on base member 10 moving down the appropriate inner arrow 1 to 6 to the appropriate inner scale A–D for the back focal length u of the lens. The intersection of this line on the inner scale will give the tracking distance between adjacent photographs.

This calculator is based upon utilization of the formula:

$$T = \frac{KFP}{(K - F)u} \tag{4}$$

It should be realized that the calculator can be based upon the formula:

$$T = \frac{BKP}{(B - K)u} \tag{3}$$

The calculator is calibrated as follows. It is first necessary to establish the closest camera to key object K distance Kc. In the case of the examples, it has been determined that the closest distance Kc from the camera to K is three feet. The scale on the base member is divided between three feet and infinity within a circle of 360°.

The location of the number of feet on the scale on the base member is determined in accordance with the following formula:

$$L = \frac{360° Kc}{K}$$

where:

L is the location in degrees of the number to be placed on the scale on the base member, K is the distance between the camera and the key subject, and Kc is the closest distance which the camera can photograph a key subject.

The closest distance Kc between the camera and the key subject used in constructing the calculator illustrated in the figures is 3 feet. Consequently, the formula used is as follows:

$$L = \frac{360 \times 3}{K}$$

The following table indicates the location in degrees on the scale on the base member of different distances to the key subject K. The following table indicates the location of the various feet numbers on the base member 10:

Table for Determining Location in Degrees

| Feet | Degree Location on Circle |
|---|---|
| 3 feet = 360 × 3/3 | 360° |
| 4 feet = 360 × 3/4 | 270° |
| 5 feet = 360 × 3/5 | 216° |
| 6 feet = 360 × 3/6 | 180° |
| 12 feet = 360 × 3/12 | 90° |
| 24 feet = 360 × 3/24 | 45° |
| 48 feet = 360 × 3/48 | 22.5° |
| 96 feet = 360 × 3/96 | 11.25° |
| 100 feet = 360 × 3/100 | 10.8° |
| ∞ | 0° |

The following examples illustrate the application of the above equations for computing the tracking distance:

EXAMPLE 1

A two-dimensional camera is mounted on a track which is horizontally spaced in relationship to the line of sight to the foreground object f and background object k to be photographed. It is desired to determine the distance between adjacent vantage points on this track so the camera can be moved the appropriate distance between photographs. In this case, it is desired that the photographs be 400 mm×500 mm. The viewing angle $\theta$ is 15° and the value of E is 3 between foreground and key subject and 6 between key subject and background. Thus:

$$P = \frac{2V\pi}{21600} E \quad (1)$$

From equation (2)

$$\begin{aligned} V &= D/(2 \tan \theta/2) \\ &= 500/(2 \tan 7.5) \\ &= 500/2(.1316525) \\ V &= 1899 \text{ mm.} \end{aligned}$$

The spatial parallax between the stereo pairs for the foreground image f:

$$\begin{aligned} Pf' &= \frac{2V\pi}{21600} \times 3 \quad (1) \\ &= 1.66 \text{ mm.} \end{aligned}$$

The spatial parallax between the stereo pairs for the background image b:

$$\begin{aligned} Pb' &= \frac{2V\pi}{21600} \times 6 \quad (1) \\ &= 3.32 \text{ mm.} \end{aligned}$$

EXAMPLE 2

The tracking distance (T) can be determined with the application of the above equation based upon the following assumptions:

K=10 feet (3048 mm)

F=7 feet (2134 mm)

B=25 feet (7620 mm)

u=100 mm

The length of the negative is 60 mm. and the viewing angle $\theta$ is 15° and the value of E is 2. Thus, using equation 2 to determine the viewing distance (V):

$$V = D/(2 \tan \theta/2)$$

$$V = 60/2 \tan 15/2)$$

$$V = 60/2(0.1316525)$$

$$V = 228 \text{ mm.}$$

Thus, using the equation 1 to determine the parallax (P):

$$P = \frac{2V\pi}{21600} E$$

$$P = \frac{2(228)3.1416}{21600} 2$$

$$P = .1326$$

Then, using equation 3 for computing the distance (T) between vantage points:

$$T = \frac{BKP}{(B - K)u}$$

$$T = \frac{(7620)(3048)(.1326)}{(7620 - 3048)100}$$

$$T = 6.7 \text{ mm.}$$

If a 50 mm lens is used, then:

$$T = \frac{(7620)(3048)(.1326)}{(7620 - 3048)50}$$

$$T = 13.5 \text{ mm.}$$

If the foreground equation 4 is used for 100 mm lens:

$$T = \frac{KFP}{(K - F)u}$$

$$T = \frac{(3048)(2134)(.1326)}{(3048 - 2134)100}$$

$$T = 9.4 \text{ mm.}$$

The foreground equation 3 results in a slightly greater tracking distance because the foreground object is closer to the key subject. In this case, the smaller distance of 6.7 mm should be used to keep the parallax within the desired scanning angle.

EXAMPLE 3

If the key subject distance K is 8 feet (2438 mm), and Foreground distance (F) is 6.5 feet (1981 mm), and Background distance (B) is 15 feet (4572 mm), Camera focal length (u) is 200 mm and P is 0.1326, then using equation 3:

$$T = \frac{(4572)(2438)(.1326)}{(4572 - 2438)200}$$

$$T = 3.5 \text{ mm.}$$

Equations 3 and 4 can be used to aid a photographer in deciding where to place the foreground and background objects to obtain the desired parallax.

EXAMPLE 4

The tracking distance for the situation set forth in Example 2 can be computed on the calculator very quickly by following the following steps: First, rotate the inner member so that key arrow 22 is pointed at 10 feet on the outer scale as illustrated in FIG. 3. The foreground distance F is 7 feet which is represented on the scale on the base member 10. Seven feet is close to arrow 3 on the inner member 20. Since this is a 100 millimeter lens and the scale for a 100 millimeter lens (302 on FIG. 4) intersects at 7 mm (312 on FIG. 4) which is the tracking distance. If a 50 millimeter lens (301 on FIG. 4) is used, the intersection is at 15 mm (311 FIG. 4). FIG. 5 illustrates the computation for a 200 millimeter lens (304) under the circumstances of Example 3. The tracking distance is approximately 5 mm as represented by 314 in FIG. 5.

EXAMPLE 5

Figure 6:
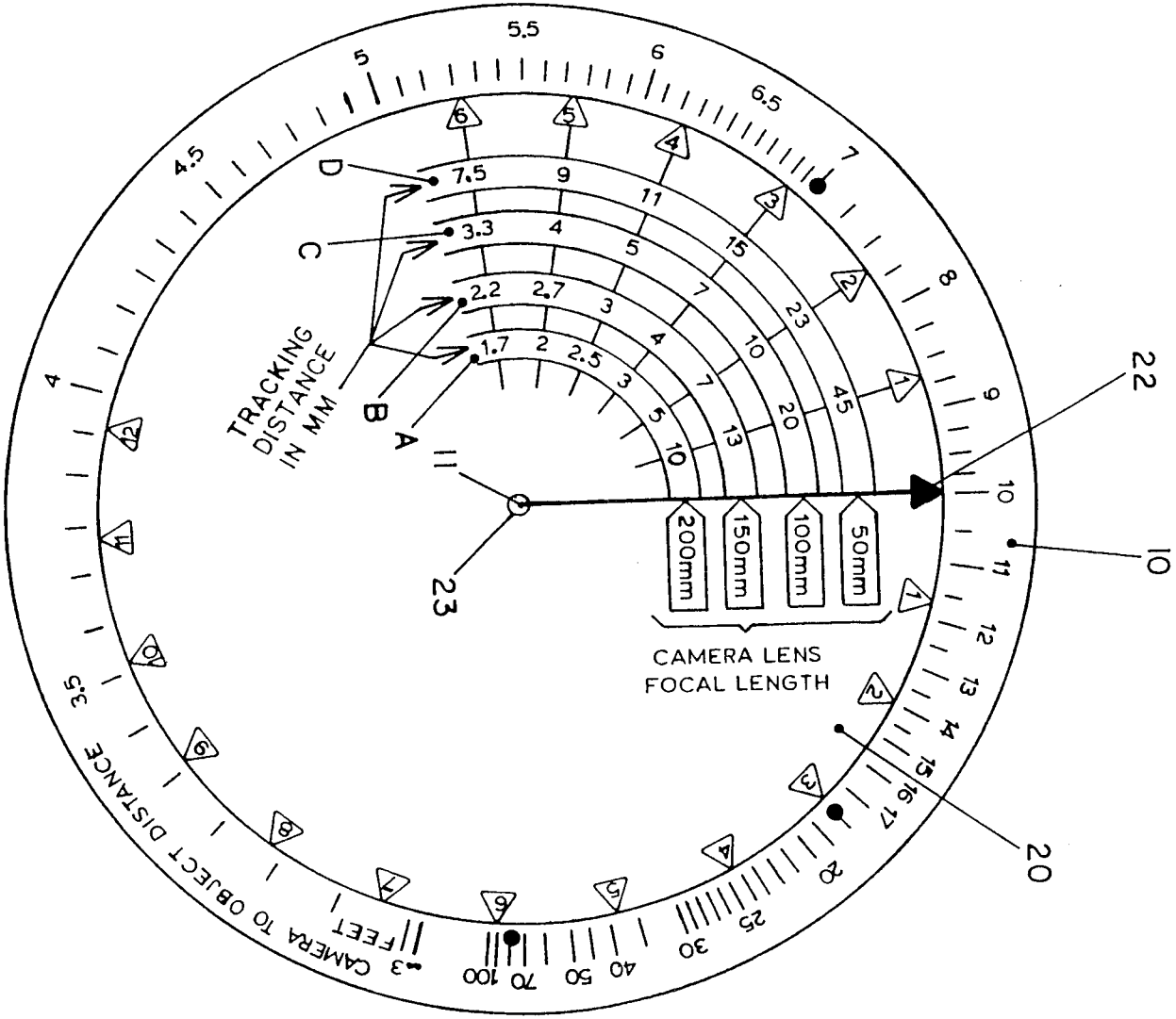
FIG. 6 portrays the calculator at a particular setting so that the tracking distance of the camera can be determined.

As illustrated by FIG. 6, the calculator can be used to assist the photographer in deciding the placement of either the foreground object f or the background object b in relation to the key subject k in order to obtain the desired parallax between the key subject and the background subject in the final picture. For example, when K is equal to 10 feet and F is 7 feet, the background object can be determined by rotating the inner member so that 30 the key arrow 22 is pointed at 10 feet with the foreground object being at 7 feet which is represented on the scale under the base number 10. Seven feet is close to arrow 3 on the inner member 20. Consequently, the background object would be located close to arrow 3 on the right side the key arrow 22 which is approximately 18 feet. If you wish to increase the background parallax to 200% of the parallax for the foreground parallax, then it would be necessary to locate the background object twice the number of basic arrows on the left side (3×2) which would be position number 6 on the right hand side at approximately 80 feet.

EXAMPLE 6

Figure 7:
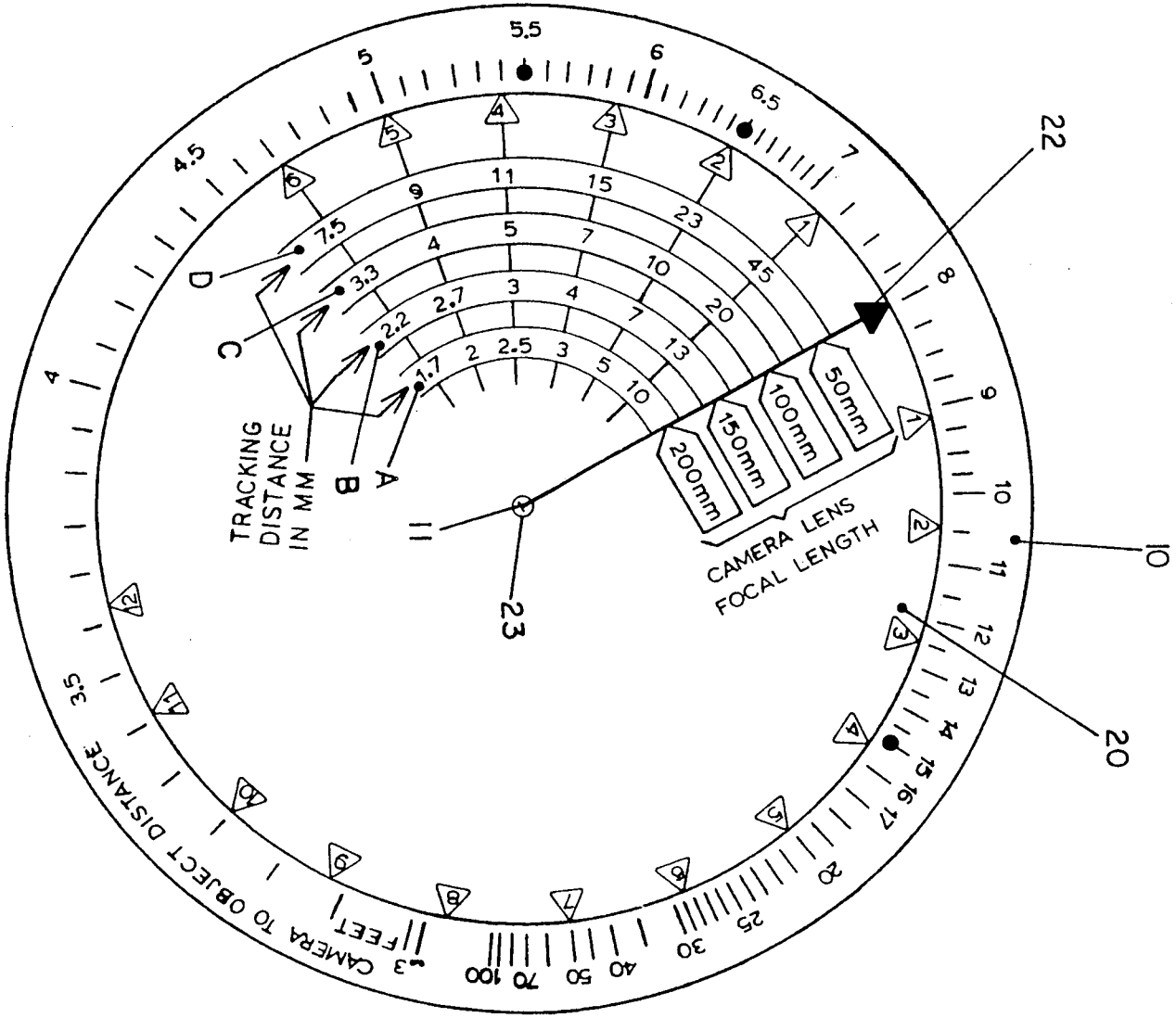
FIG. 7 portrays the calculator at a particular setting so that the tracking distance of the camera can be determined.

This example is based upon the illustration in FIG. 7. The location of the foreground object f can be determined on the basis of this calculator in the following manner. If K is 8 feet and the background object B is 15 feet which is 4 base points to the right of the background object b, then the foreground object f is located 4 points to the left of the key arrow 22 at 5.5 feet when L the desired foreground parallax is 100% of the background parallax. However, if the foreground parallax is to be 50% of the background parallax, then the foreground object F would be located at 6.5 feet or 2 base points to the left of the key arrow 22. In this way the calculator can be utilized to determine the proper placement of the foreground f or the background object b in photographing a view.

I claim:

1. In a method of making a three-dimensional lenticular photograph of a scene including a key object and a foreground object located between a veiwer of said scene and said key object, said photograph having width D, the method including the steps of exposing with a single-lens camera said scene from a first vantage point, movign said camera laterally with respect to said scene over a distance T and there exposing said scene from a second vantage point, the improvement comprising a method of calculating said distance T including the steps of:

(a) first calculating a distance V at which an observer will observe said photograph in accordance with the equation:

$$V = D/(2 \tan (\theta/2)$$

wherein $\theta$ is a predetermined viewing angle of said photograph;

(b) calculating a spatial parallax P for said photograph in accordance with the equation:

$$P = \frac{2V\pi}{21600} E,$$

wherein $\pi$ is 3.1416 and E is a preselected value from 2 to 10 arc minutes representative of the ability of the eyes of said observer to fuse two images of said three-dimensional photograph together; and (c) calculating said distance T in accordance with the equation:

$$T = \frac{FKP}{(K - F)u},$$

wherein K is the distance between said camera and said key object, F is the distance between said camera and said foreground object, and u is the back focal length of said single-lens camera.

2. The method as defined in claim 1, wherein said viewing angle $\theta$ is 15°.

3. The method as defined in claim 1, wherein said preselected value E is 3 arc minutes.

4. In a method of making a three-dimensional lenticular photograph of a scene including a key object and a background object located beyond said key object with respect to a viewer of said scene, said photograph having width D, the method including the steps of exposing with a single-lens camera said scene from a first vantage point, moving said camera laterally with respect to said scene over a distance T and there exposing said scene ffrom a second vantage point, the improvement comprising a method of calculating said distance T including the steps of:

(a) first calculating a distance V at which an observer will observe said photograph in accordance with the equation:

$$V = D/(2 \tan (\theta/2)),$$

wherein $\theta$ is a predetermined viewing angle of said photograph;

(b) calculating a spatial parallax P for said photograph in accordance with the equation:

$$P = \frac{2V\pi}{21600} E,$$

wherein $\pi$ is 3.1416 and E is a preselected value from 2 to 10 arc minutes representative of the ability of the eyes of said observer to fuse two images of said three-dimensional photograph together; and (c) calculating said distance T in accordance with the equation:

$$T = \frac{BKP}{(B - K)u},$$

wherein K is the distance between said camera and said key object, B is the distance between said camera and said foreground object, and u is the back focal length of said single-lens camera.

5. The method as defined in claim 4, wherein said viewing angle $\theta$ is 15°.

6. The method as defined in claim 4, wherein said preselected value E is 3 arc minutes.

7. The method as defined in claim 4, comprising the further steps of:

(d) recalculating said distance T in accordance with the equation:

$$T = \frac{FKP}{(K - F)u},$$

wherein F is the distance between said camera and a foreground object located within said scene between said camera and said key object; and (e) taking as said distance T the smaller of the values calculated therefor in steps (c) and (d).

8. A calculator for use in making a three-dimensional lenticular photographic of a scene including a key object and a foreground object located between a viewer of said scene and said key object, said photograph having width D and being made by xposing with a single-lens camera said scene from a first vantage point, moving said camera laterally with respect to said scene over a distance T and there exposing said scene from a second vantage point, said calculator being for determining said distance T and comprising:

a base member;

an inner member which is substantially circular, said inner member being rotatably attached at the center thereof to said base member;

said base member having thereon a substantially circular distance scale visible about said inner member, said distance scale extending in a first angular direction from an initial angular position $L_c$ in accordance with the equation:

$$L = \frac{360° K_c}{K},$$

wherein L is an angular position about said circular scale from said initial position $L_c$, K is the distance between said camera and said key object, and $K_c$ is a predetermined closest possible distance from said camera to said key object;

said inner member having a key arrow thereon extending radially outwardly;

said inner member further having a tracking distance scale including values for said distance T extending in a second angular direction opposite to said first angular direction, wherein upon alignment of said key arrow with a value for said distance K, said values for said distance T align with values along said circular scale corresponding to the distance F between said camera and said foreground objec, said values for said distance T being predetermined by the equations:

$$V = D/(2 \tan (\theta/2)),$$

wherein $\theta$ is a predetermined viewing angle of said photograph, and V is a corresponding distance at which an observer will observe said photograph, $$P = \frac{2V\pi}{21600} E,$$

wherein $\pi$ is 3.1416, E is a preselected value from 2 to 10 arc minutes representative of the ability of the eyes of said observer to fuse two images of said three-dimensional photograph together, and P is a spatial parallax for said photograph, and $$T = \frac{FKP}{(K - F)u},$$

wherein u is the back focal length of said single-lens camera.

9. The calculator as defined in claim 8, further comprising a plurality of secondary arrows arranged on said inner member angularly from said key arrow in said second direction and intersecting said tracking distance scale to facilitate aligning said values for said distance T with said values for said distance F.

10. The calculator as defined in claim 8, further comprising additional ones of said tracking distance scale, each fo said tracking distacne scales corresponding to a different value u of said back focal length of said camera.

11. The calculator as defined in claim 8, wherein said viewing angle $\theta$ is 15°.

12. The calculator as defined in claim 8, wherein said preselected value E is 3 arc minutes.

* * * * *